US012024874B2

(12) United States Patent
Gutierrez Flores

(10) Patent No.: US 12,024,874 B2
(45) Date of Patent: Jul. 2, 2024

(54) MODULAR SUPPORT ASSEMBLY

(71) Applicant: Juan Carlos Gutierrez Flores, San Diego, CA (US)

(72) Inventor: Juan Carlos Gutierrez Flores, San Diego, CA (US)

( * ) Notice: Subject to any disclaimer, the term of this patent is extended or adjusted under 35 U.S.C. 154(b) by 667 days.

(21) Appl. No.: 17/023,624

(22) Filed: Sep. 17, 2020

(65) Prior Publication Data

US 2022/0081892 A1 Mar. 17, 2022

(51) Int. Cl.

| | |
|---|---|
| ***E04B 1/19*** | (2006.01) |
| ***A63B 69/20*** | (2006.01) |
| ***A63B 69/30*** | (2006.01) |
| *A63B 71/02* | (2006.01) |

(52) U.S. Cl.

CPC ..... *E04B 1/19* (2013.01); *A63B 69/305* (2022.08); *A63B 2071/024* (2013.01); *E04B 2001/1927* (2013.01)

(58) Field of Classification Search

CPC . A47B 47/00; A47B 47/0008; A47B 47/0016; A47B 47/0058; A47B 47/0091; A47B 47/02; A47B 47/027; A47B 47/028; A47B 47/04; A47B 47/045; A47B 47/047; A63B 3/00; A63B 9/00; A63B 17/00; A63B 17/04; A63B 69/222; A63B 69/305; E04B 1/19; E04B 2001/1927; E04B 2001/1933; E04B 2001/1984; E04B 2001/2448

USPC ..... 211/85.7

See application file for complete search history.

(56) References Cited

U.S. PATENT DOCUMENTS

| | | | | | |
|---|---|---|---|---|---|
| 1,142,137 | A * | 6/1915 | Bathrick | A63B 3/00 | 482/41 |
| 1,538,203 | A * | 5/1925 | Moran | A63B 69/34 | 473/443 |
| 1,737,971 | A * | 12/1929 | Law | F16B 12/40 | 211/182 |
| 2,726,866 | A | 12/1955 | Nally | | |
| 3,397,882 | A * | 8/1968 | Reuther | A63B 3/00 | 482/42 |
| 3,547,435 | A * | 12/1970 | Scott | A63B 9/00 | 482/37 |
| 3,653,658 | A * | 4/1972 | Robertson | A63B 3/00 | 482/25 |

(Continued)

FOREIGN PATENT DOCUMENTS

WO WO2011100644 8/2011

*Primary Examiner* — Joshua E Rodden

(57) ABSTRACT

A modular support assembly for hanging exercising and training apparatus includes a pair of vertical elements and a horizontal element. The horizontal element is configured to selectively engage upper ends of the vertical elements so that the two vertical elements extend perpendicularly and codirectionally from opposed ends of the horizontal element to a surface. Exercising or training apparatus can be hung from the horizontal element. The vertical elements are two of a plurality of vertical elements and the horizontal element is one of a plurality of horizontal elements. Each vertical element can selectively engage respective opposed ends of two horizontal elements so that the two horizontal elements extend perpendicularly from the upper end of the vertical element. The set of horizontal elements and the set of vertical elements thus are selectively positionable in a variety of rectangular configurations.

8 Claims, 7 Drawing Sheets

(56) References Cited

U.S. PATENT DOCUMENTS 3,850,428 A * 11/1974 Zuber ..... A63B 9/00 482/36
4,278,250 A * 7/1981 Baynes ..... A63B 17/00 482/34
4,295,648 A * 10/1981 Stromback ..... A63B 63/00 473/456
4,555,107 A * 11/1985 Otto ..... A63B 3/00 482/42
4,630,550 A * 12/1986 Weitzman ..... A47B 13/06 403/171
5,308,083 A * 5/1994 Grunfeld ..... A63B 63/004 273/400
5,326,337 A * 7/1994 Pardella ..... A63B 9/00 403/49
5,611,760 A * 3/1997 Jordan ..... A63C 19/005 482/93
6,348,028 B1 * 2/2002 Cragg ..... A63B 21/0628 482/148
6,394,932 B1 * 5/2002 Chu ..... A63B 1/00 482/37
6,530,867 B2 * 3/2003 Schwendemann ... A63B 69/305 482/90
6,948,713 B1 * 9/2005 Grunfeld ..... A63B 71/023 273/400
6,994,655 B2 * 2/2006 Chu ..... A63B 71/023 472/118
7,658,699 B1 * 2/2010 Johnson, Jr. ..... A63B 69/305 482/83
D635,206 S 3/2011 Henniger
8,109,862 B2 2/2012 Cooper
8,876,616 B2 11/2014 Antuna
2005/0176557 A1 * 8/2005 Bork ..... A63B 17/04 482/37
2013/0165302 A1 * 6/2013 Verdi ..... A63B 21/4007 482/143
2019/0111295 A1 * 4/2019 Watson ..... F16B 21/12
2021/0113902 A1 * 4/2021 Nuñez Lantigua .. A63B 71/023
2022/0168605 A1 * 6/2022 Janicki ..... A63B 17/02
2022/0395740 A1 * 12/2022 Curry ..... A63B 69/20
2022/0408915 A1 * 12/2022 Keller ..... A47B 47/0091
2023/0013163 A1 * 1/2023 Keller ..... A47B 47/028

* cited by examiner

MODULAR SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to support assemblies and more particularly pertains to a new support assembly for hanging exercising and training apparatus.

(2) Description of Related Art Including Information Disclosed Under 37 CFR 1.97 and 1.98

The prior art relates to support assemblies. Prior art support assemblies may comprise interconnectable posts and beams.

BRIEF SUMMARY OF THE INVENTION

An embodiment of the disclosure meets the needs presented above by generally comprising a pair of vertical elements and a horizontal element. The horizontal element is configured to selectively engage upper ends of the vertical elements so that the two vertical elements extend perpendicularly and codirectionally from opposed ends of the horizontal element to a surface. The horizontal element thus is configured to hang exercising or training apparatus therefrom.

The vertical elements are two of a plurality of vertical elements and the horizontal element is one of a plurality of horizontal elements. Each vertical element is configured to selectively engage respective opposed ends of two horizontal elements so that the two horizontal elements extend perpendicularly from the upper end of the vertical element. The set of horizontal elements and the set of vertical elements thus are selectively positionable in a variety of rectangular configurations.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
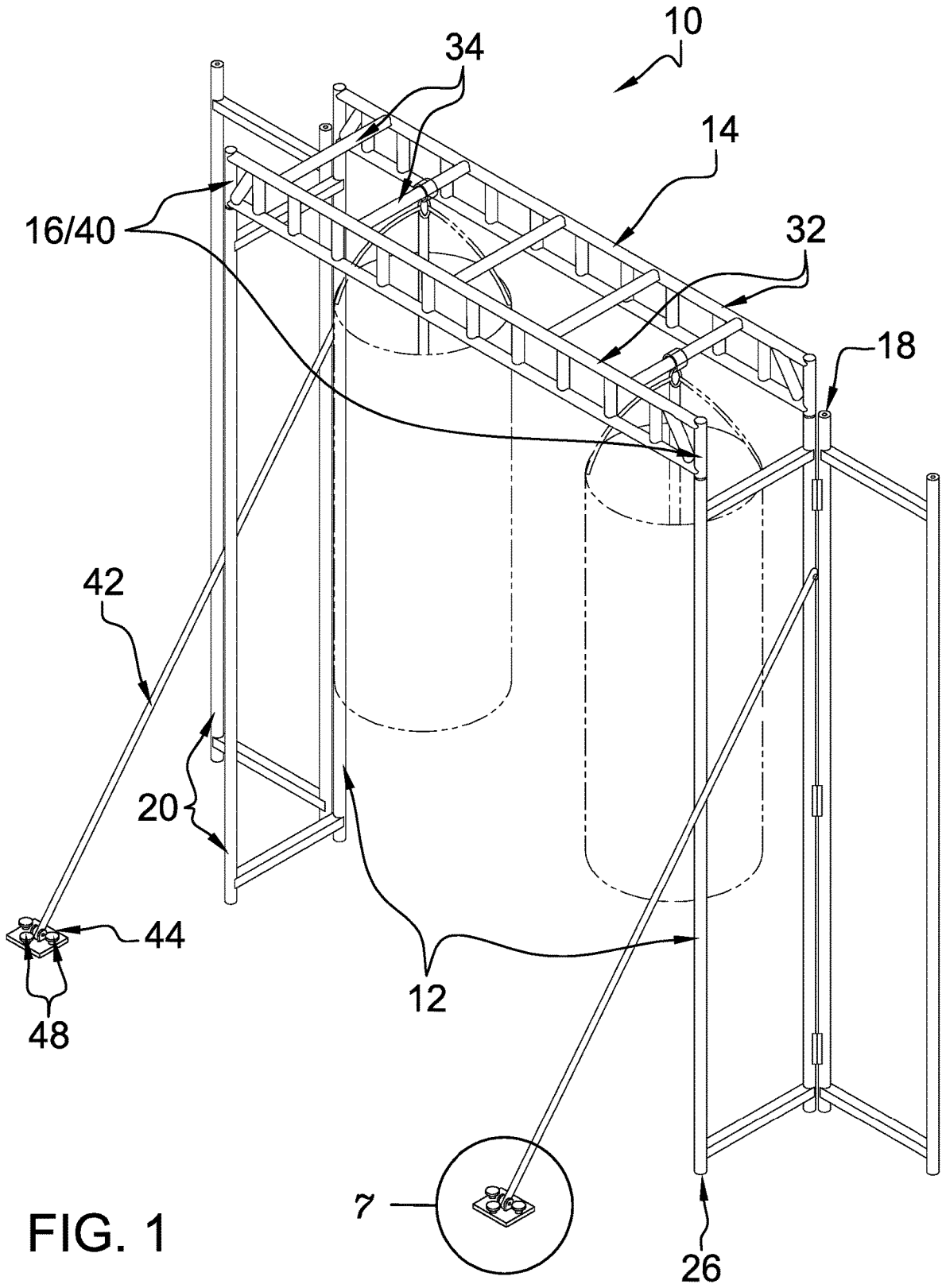
FIG. 1 is an isometric perspective view of a modular support assembly according to an embodiment of the disclosure.

With reference now to the drawings, and in particular to FIGS. 1 through 9 thereof, a new support assembly embodying the principles and concepts of an embodiment of the disclosure and generally designated by the reference numeral 10 will be described.

As best illustrated in FIGS. 1 through 9, the modular support assembly 10 generally comprises a pair of vertical elements 12 and a horizontal element 14. The horizontal element 14 is configured to selectively engage upper ends 18 of the vertical elements 12 so that the two vertical elements 12 extend perpendicularly and codirectionally from opposed ends 16 of the horizontal element 14 to a surface. The horizontal element 14 thus is configured to hang exercising or training apparatus therefrom, such as heavy bags and speed bags used in training of fighters.

Figure 9:
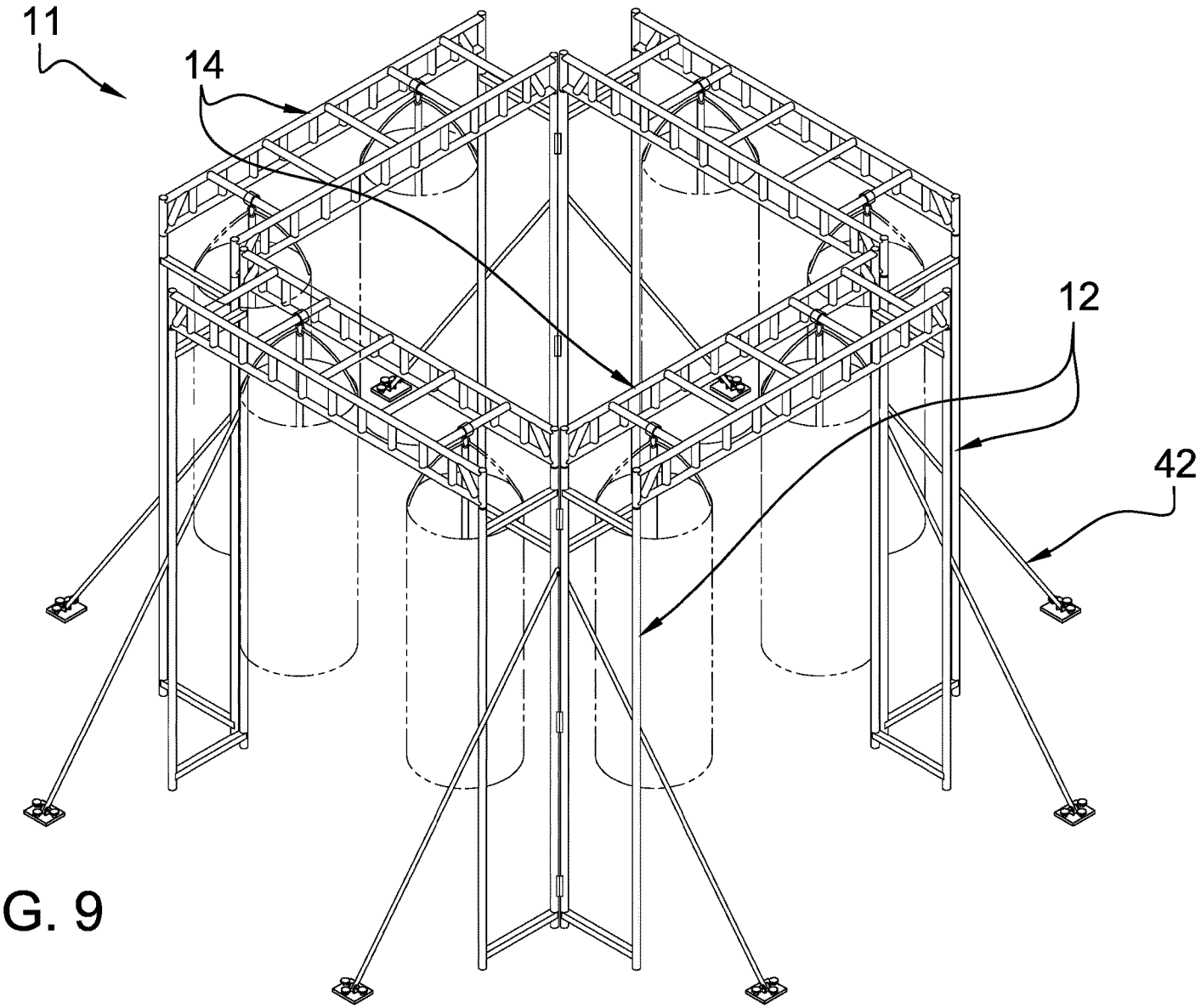
FIG. 9 is an isometric perspective view of an embodiment of the disclosure.

The vertical elements 12 are two of a plurality of vertical elements 12 and the horizontal element 14 is one of a plurality of horizontal elements 14. Each vertical element 12 is configured to selectively engage respective opposed ends 16 of two horizontal elements 14 so that the two horizontal elements 14 extend perpendicularly from the upper end 18 of the vertical element 12. The set of horizontal elements 14 and the set of vertical elements 12 thus are selectively positionable in a variety of rectangular configurations, as in FIG. 9 wherein the horizontal elements 14 and the vertical elements 12 are shown in a square configuration. As shown in FIG. 9, the support assembly 10 comprises a ring positioned within the square configuration, speed bags positioned between the horizontal elements 14, and heavy bags hanging from the horizontal elements.

Figure 2:
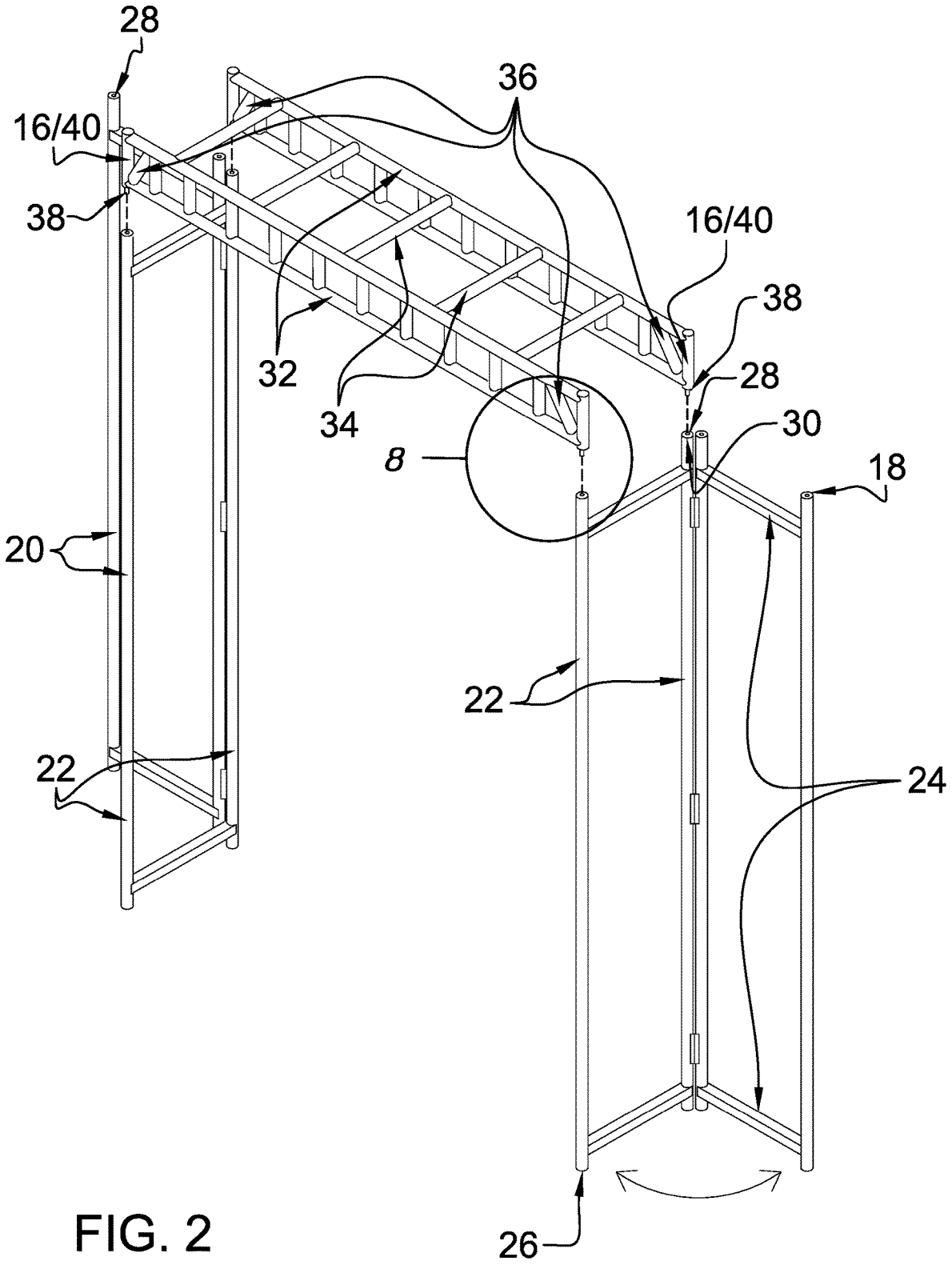
FIG. 2 is an exploded view of an embodiment of the disclosure.
Figure 3:
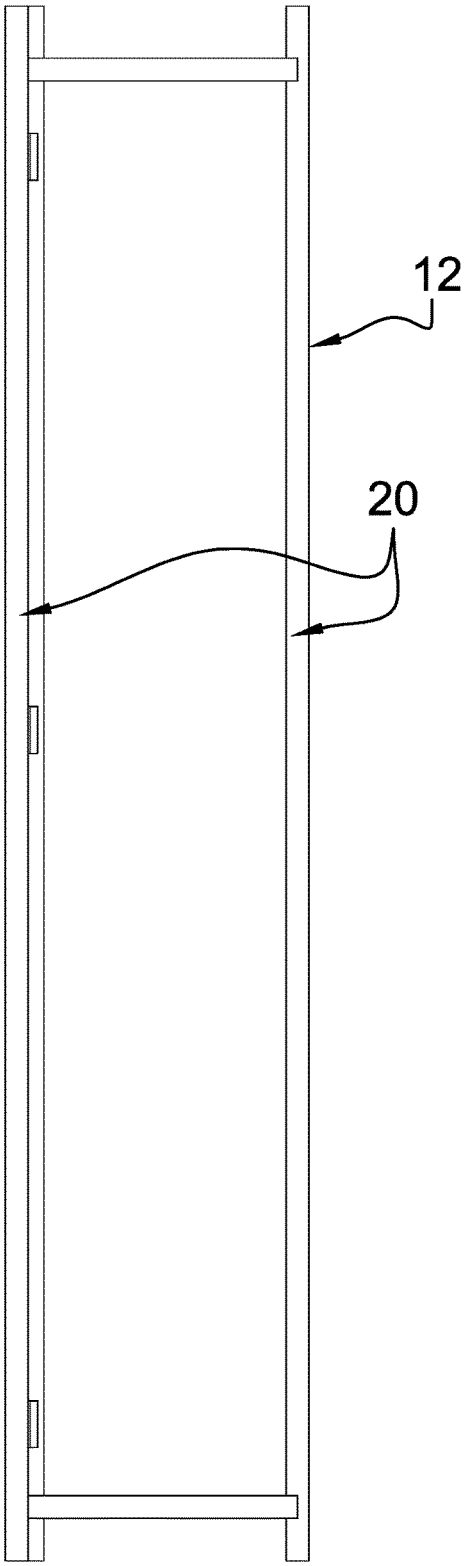
FIG. 3 is a front view of an embodiment of the disclosure.
Figure 4:
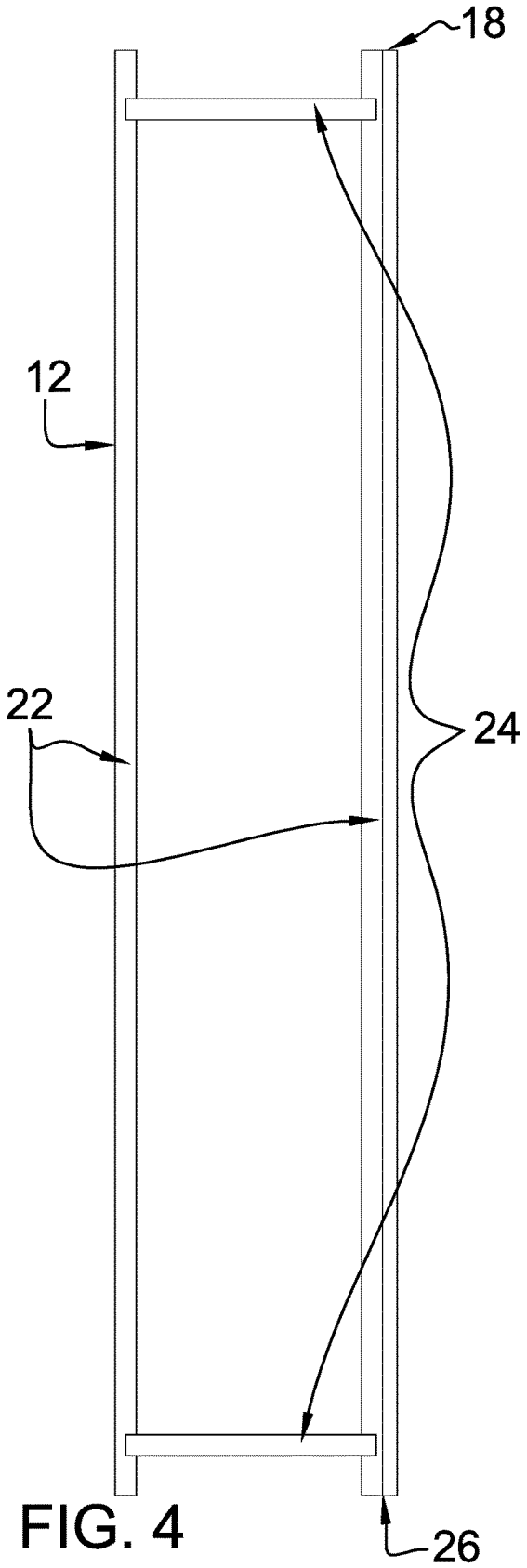
FIG. 4 is a rear view of an embodiment of the disclosure.
Figure 5:
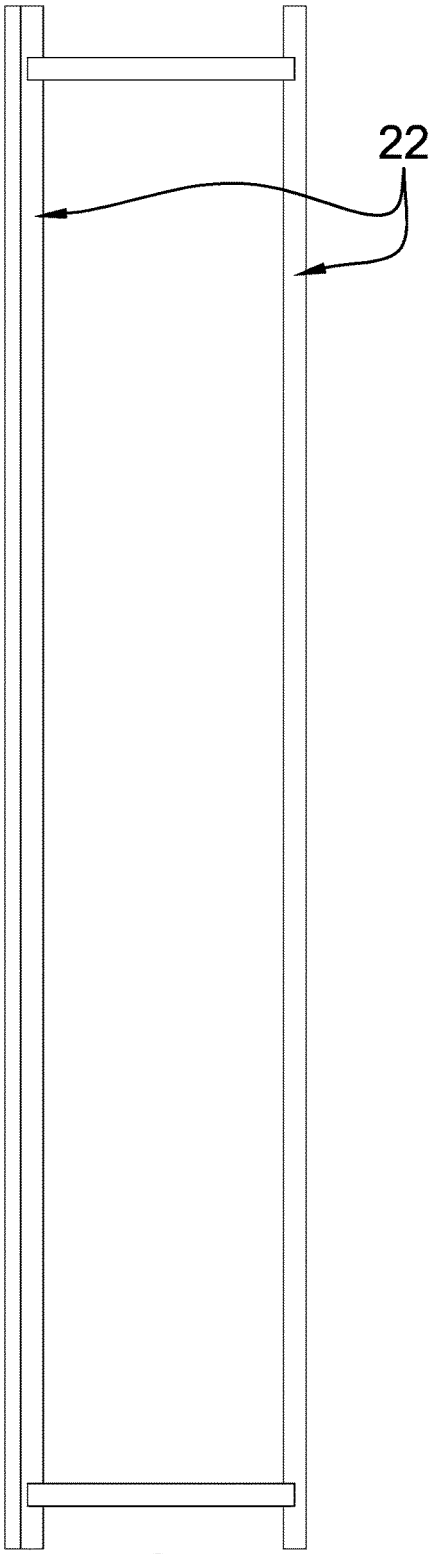
FIG. 5 is a side view of an embodiment of the disclosure.
Figure 6:
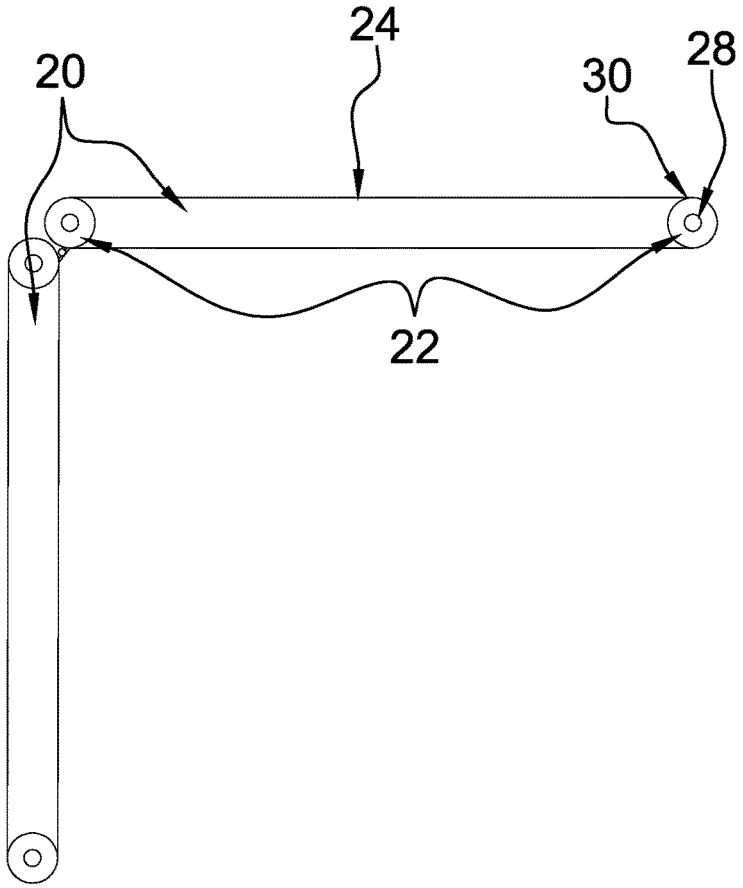
FIG. 6 is a top view of an embodiment of the disclosure.

Each vertical element 12 comprises a pair of frames 20, which are hingedly interconnected so that the pair of frames 20 is selectively positionable in a folded configuration and a deployed configuration, as shown in FIG. 2. In the folded configuration, the frames 20 are in substantial abutment. In the deployed configuration, one of the frames 20 is perpendicular to the other of the frames 20.

Each frame 20 comprises a pair of end beams 22 and a set of crossbeams 24. Each crossbeam 24 is engaged to and extends perpendicularly between the end beams 22 of the pair of end beams 22 so that the frame 20 is rectangularly shaped. The set of crossbeams 24 comprises two crossbeams 24, which are positioned singly proximate to the upper end 18 and a lower end 26 of the vertical element 12. Each end beam 22 has a channel 28 extending thereinto from an upper limit 30 thereof.

Figure 8:
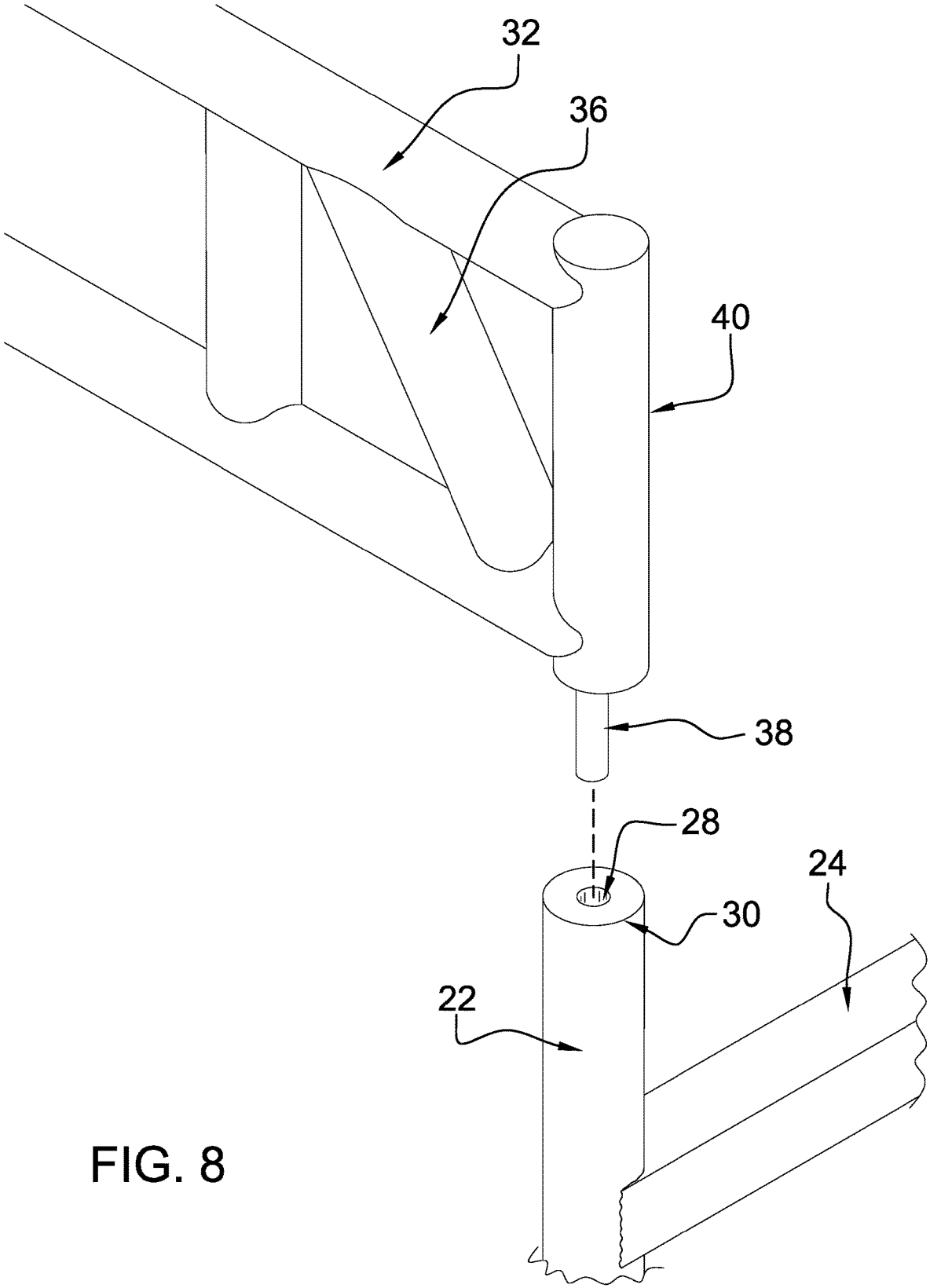
FIG. 8 is a detail view of an embodiment of the disclosure.

Each horizontal element 14 comprises a pair of trusses 32 and a plurality of crossbars 34, with each crossbar 34 being engaged to and extending perpendicularly between the trusses 32. The horizontal element 14 also may comprise a set of gussets 36, with each gusset 36 being engaged to a respective truss 32 proximate to a respective opposed end 16 of the horizontal element 14, as shown in FIG. 8.

Each truss 32 has a pair of pins 38 is engaged thereto and extending therefrom. The pins 38 are positioned at opposed endpoints 40 of the truss. Each pin 38 is positioned for insertion into a respective channel 28, as shown in FIG. 8, to engage the truss 32 to the frames 20 so that the vertical element 12 extends therebetween. The assembly 10 can be transported, erected, and knocked down with ease.

Each of a plurality of rods 42 is hingedly engaged to a respective vertical element 12 and can be extended transversely to the surface upon which the vertical element 12 is positioned, as shown in FIGS. 1 and 9. The rod 42 is configured to stabilize the vertical element 12 in a position substantially perpendicular to the surface.

Figure 7:
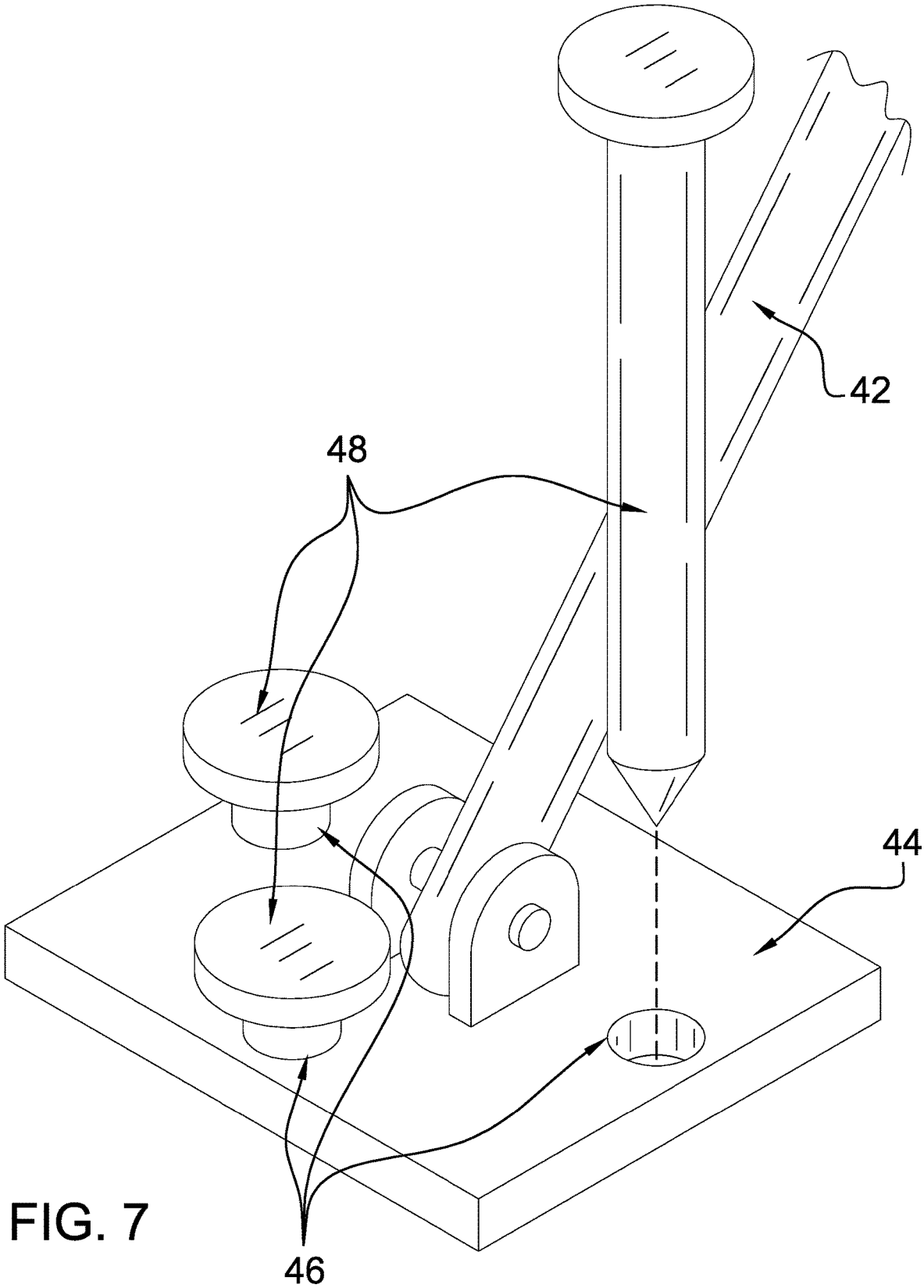
FIG. 7 is a detail view of an embodiment of the disclosure.

The rod 42 has a plate 44 hingedly engaged thereto distally from the respective vertical element 12, as shown in FIG. 7. The plate 44 has a plurality of holes 46 positioned therethrough. Each of a set of spikes 48 is selectively insertable through a respective hole 46 into the surface to attach the plate 44 to the surface.

In use, the plurality of vertical elements 12 and the plurality of horizontal elements 14 are assembled into a rectangular configuration by inserting the pins 38 into the channels 28 to engage the horizontal elements 14 to the vertical elements 12. The rods 42 are positioned to extend between the vertical elements 12 and the surface. The spikes 48 are inserted through the holes 46 into the surface to stabilize the assembly 10. The exercising or training apparatus then can be hung from the horizontal elements 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A modular support assembly comprising:

a plurality of vertical elements;

a plurality of horizontal elements, each horizontal element being configured for selectively engaging upper ends of an associated pair of the vertical elements, such that the pair of vertical elements extend perpendicularly and codirectionally from opposed ends of the horizontal element to a surface, wherein each horizontal element is configured for hanging of exercising or training apparatus therefrom;

each vertical element being configured for selectively engaging respective opposed ends of an associated pair of the horizontal elements, such that the associated pair of the horizontal elements extends perpendicularly from the upper end of the vertical element, such that the plurality of horizontal elements and the plurality of vertical elements is selectively positionable in a rectangular configuration;

each vertical element comprising a pair of frames, the frames being hingedly interconnected such that the pair of frames is selectively positionable in a folded configuration, wherein the frames are in substantial abutment, and a deployed configuration, wherein one of the frames is perpendicular to the other of the frames; and each horizontal element comprising a pair of trusses and a plurality of crossbars, each crossbar being engaged to and extending perpendicularly between the trusses.

2. The modular support assembly of claim 1, further including each frame comprising a pair of end beams and a set of crossbeams, each crossbeam being engaged to and extending perpendicularly between the end beams of the pair of end beams, such that the frame is rectangularly shaped.

3. The modular support assembly of claim 1, further including each horizontal element comprising a set of gussets, each gusset being engaged to a respective truss proximate to a respective opposed end of the horizontal element.

4. The modular support assembly of claim 2, further including the set of crossbeams comprising two crossbeams positioned singly proximate to the upper end and a lower end of the vertical element.

5. The modular support assembly of claim 2, further including:

each end beam having a channel extending thereinto from an upper limit thereof; and each truss having a pair of pins engaged thereto and extending therefrom, the pins being positioned at opposed endpoints of the truss, such that each pin is positioned for inserting into a respective channel for engaging the truss to the frames, such that the vertical element extends therebetween.

6. The modular support assembly of claim 1, further including a plurality of rods, each rod being hingedly engaged to a respective vertical element and transversely extendable to the surface upon which the vertical element is positioned, wherein the rod is configured for stabilizing the vertical element in a position substantially perpendicular to the surface.

7. A modular support assembly comprising:

a plurality of vertical elements;

a plurality of horizontal elements, each horizontal element being configured for selectively engaging upper ends of an associated pair of the vertical elements, such that the pair of vertical elements extend perpendicularly and codirectionally from opposed ends of the horizontal element to a surface, wherein each horizontal element is configured for hanging of exercising or training apparatus therefrom;

each vertical element being configured for selectively engaging respective opposed ends of an associated pair of the horizontal elements, such that the associated pair of the horizontal elements extends perpendicularly from the upper end of the vertical element, such that the plurality of horizontal elements and the plurality of vertical elements is selectively positionable in a rectangular configuration;

a plurality of rods, each rod being hingedly engaged to a respective vertical element and transversely extendable to the surface upon which the vertical element is positioned, wherein the rod is configured for stabilizing the vertical element in a position substantially perpendicular to the surface, the rod having a plate hingedly engaged thereto distally from the respective vertical element, the plate having a plurality of holes positioned therethrough; and a set of spikes, each spike being selectively insertable through a respective hole into the surface for attaching the plate to the surface.

8. A modular support assembly comprising:

a plurality of vertical elements, each vertical element comprising a pair of frames, the frames being hingedly interconnected such that the pair of frames is selectively positionable in a folded configuration, wherein the frames are in substantial abutment, and a deployed configuration, wherein one of the frames is perpendicular to the other of the frames, each frame comprising a pair of end beams and a set of crossbeams, each crossbeam being engaged to and extending perpendicularly between the end beams of the pair of end beams, such that the frame is rectangularly shaped, each end beam having a channel extending thereinto from an upper limit thereof, the set of crossbeams comprising two crossbeams positioned singly proximate to an upper end and a lower end of the vertical element;

a plurality of horizontal elements, each horizontal element configured for selectively engaging the upper ends of an associated pair of the vertical elements, such that the associated pair of the vertical elements extends perpendicularly and codirectionally from opposed ends of the horizontal element to a surface, wherein each horizontal element is configured for hanging of exercising or training apparatus therefrom, each horizontal element comprising a pair of trusses and a plurality of crossbars, each crossbar being engaged to and extending perpendicularly between the trusses, each truss having a pair of pins engaged thereto and extending therefrom, the pins being positioned at opposed endpoints of the truss, such that each pin is positioned for inserting into a respective channel for engaging the truss to the frames, such that the vertical element extends therebetween, each horizontal element comprising a set of gussets, each gusset being engaged to a respective truss proximate to a respective opposed end of the horizontal element;

each vertical element being configured for selectively engaging respective opposed ends of two horizontal elements, such that the two horizontal elements extend perpendicularly from the upper end of the vertical element, such that the set of horizontal elements and the set of vertical elements is selectively positionable in a rectangular configuration;

a plurality of rods, each rod being hingedly engaged to a respective vertical element and transversely extendable to the surface upon which the vertical element is positioned, wherein the rod is configured for stabilizing the vertical element in a position substantially perpendicular to the surface, the rod having a plate hingedly engaged thereto distally from the respective vertical element, the plate having a plurality of holes positioned therethrough; and a set of spikes, each spike being selectively insertable through a respective hole into the surface for attaching the plate to the surface.

* * * * *